US007134425B2

(12) United States Patent
Taguchi et al.

(10) Patent No.: US 7,134,425 B2
(45) Date of Patent: Nov. 14, 2006

(54) STRUCTURE OF FUEL SUPPLY PIPE IN THROTTLE BODY COMPRISING TWO FUEL INJECTION VALVES

(75) Inventors: Naohiro Taguchi, Kawasaki (JP); Shunsuke Mochizuki, Kawasaki (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 11/365,494

(22) Filed: Mar. 2, 2006

(65) Prior Publication Data

US 2006/0201486 A1 Sep. 14, 2006

(30) Foreign Application Priority Data

Mar. 2, 2005 (JP) ..... 2005-057370

(51) Int. Cl.
*F02M 37/04* (2006.01)

(52) U.S. Cl. ..... 123/470; 123/468

(58) Field of Classification Search ..... 123/470, 123/472, 468, 469, 456, 337, 336
See application file for complete search history.

(56) References Cited

U.S. PATENT DOCUMENTS 3,868,936 A * 3/1975 Rivere ..... 123/445
4,132,204 A * 1/1979 Teague ..... 123/456
4,235,205 A * 11/1980 Fukui et al. ..... 123/472
4,323,041 A * 4/1982 Endo et al. ..... 123/432
4,516,555 A * 5/1985 Shioya et al. ..... 123/470
6,039,029 A * 3/2000 Nagasaka et al. ..... 123/442
6,732,711 B1 * 5/2004 Yanagii ..... 123/469
6,971,371 B1 * 12/2005 Hotta et al. ..... 123/470
7,028,665 B1 * 4/2006 Taguchi ..... 123/336
2005/0188959 A1 * 9/2005 Udono ..... 123/470

* cited by examiner

*Primary Examiner*—Carl S. Miller
(74) *Attorney, Agent, or Firm*—Bacon & Thomas

(57) ABSTRACT

To simplify fuel piping for connecting a fuel distribution pipe and a fuel pump in a throttle body comprising two fuel injection valves, a fuel supply pipe F comprises a first fuel supply pipe 1 having a fuel flow-in passage 1*b* projected from a first cylindrical portion 1*a*, a first inserting pipe 1*c* projected in one side direction X, a fuel flow-in passage 1*d*, and a first fuel supply passage, a second fuel supply pipe 2 having a second insert pipe 2*b* projected in the direction X from a second cylindrical portion 2*a* and fuel supply passage 2*c*, and a fuel connecting pipe 3 connecting the fuel flow-in passage 1*d* and the second fuel supply passage 2*c*, and the first and second inserting pipes 1*c*, 2*b* are inserted into first and second inserting holes 6*d*, 7*d* opened toward another side direction Y from a second fuel distribution pipe 7 respectively.

2 Claims, 4 Drawing Sheets

PRIOR ART

STRUCTURE OF FUEL SUPPLY PIPE IN THROTTLE BODY COMPRISING TWO FUEL INJECTION VALVES

BACKGROUND OF THE INVENTION

1. Field of the Invention

The present invention relates to a fuel injection device for injecting and supplying fuel toward an internal combustion engine from a fuel injection valve mounted at a throttle body, and more particularly, a structure of a fuel supply pipe in the throttle body comprising two fuel injection valves, in which a first fuel injection valve and a second injection valve are mounted at a single throttle body.

2. Description of the Conventional Art

A conventional structure of a fuel supply pipe in a throttle body comprising two injection valves is indicated in FIG. 5.

A reference numeral 30 is a throttle body in which an intake passage 31 is provided through the inside thereof. The intake passage 31 is opened and closed by a throttle valve 33 mounted at a throttle valve shaft 32. A subthrottle valve 34 is mounted at a subthrottle valve shaft 35 on the upstream side of the throttle valve 33, and opens and closes the intake passage 31.

The throttle valve 33 controls an air content flowing toward the internal combustion engine which is not illustrated in the drawings, and the subthrottle valve 34 controls an air content flowing toward the throttle valve 33.

J1 is a first fuel injection valve for injecting and supplying the fuel into an intake passage 31*a* on the downstream side of the throttle valve 33, and the first fuel injection valve J1 shares a fuel supply area at the time of low opening operation and intermediate opening operation of the internal combustion engine.

Further, the first fuel injection valve J1 is held between a first inserting hole 30*a* of the throttle body 30 and a first fuel injection valve inserting hole 36*a* of a first fuel distribution pipe 36. At this time, a longitudinal axial line J1*a*—J1*a* of the first fuel injection valve J1 is arranged to have a crossing angle of A° with respect to a longitudinal axial line Z—Z of the intake passage 31.

Further, the first fuel distribution valve 36 is provided with a first fuel flow-in passage 36*b*, which is connected with the first fuel injection valve inserting hole 36*a*.

J2 is a second fuel injection valve for injecting and supplying the fuel into an intake passage 31*b* on the upstream side of the throttle valve 33, and the second fuel injection valve J2 shares a fuel supply area at the time of intermediate and high opening operation of the internal combustion engine.

Further, the second fuel injection valve J2 is held between a second inserting hole 30*b* of the throttle body 30 and a second fuel injection valve inserting hole 37*a* of a second fuel distribution pipe 37. At this time, a longitudinal axial line J2*a*—J2*a* of the second fuel injection valve J2 is arranged to have a crossing angle of B° with respect to the longitudinal axial line Z—Z of the intake passage 31.

Further, the second fuel distribution valve 37 is provided with a second fuel flow-in passage 37*b*, which is connected with the second fuel injection valve inserting hole 37*a*.

In this case, the crossing angle of A° between the first fuel injection valve J1 and the intake passage 31 is acuter than the crossing angle of B° between the second fuel injection valve J2 and the intake passage 31.

That is, the crossing angle of B° is larger than the crossing angle of A°.

The reason why the crossing angle of A° of the first fuel injection valve J1 is more acute than the crossing angle of B° of the second fuel injection valve J2 as described above, is as follows. In the low and intermediate opening operations of the engine, the fuel injected from the first fuel injection valve J1 is supplied in as parallel state as possible along with the air flow flowing in the intake passage 31.

On the other hand, the reason why the crossing angle of B° of the second fuel injection valve J2 is more obtuse than the crossing angle of A° of the first fuel injection valve J1 is to prevent projecting of the second fuel injection valve J2 in the left direction in the drawings and reduce a whole size of the throttle body. Even when the crossing angle of B° of the second fuel injection valve J2 is an obtuse angle, the air flow flowing in the intake passage 31 is fast especially in the high opening operation of the throttle valve, so that the injected fuel can flow sufficiently along with the air flow.

SUMMARY OF THE INVENTION

According to such the conventional throttle body comprising two fuel injection valves, the first fuel flow-in passage 36*b* of the first fuel distribution pipe 36 is connected with a fuel pump discharge passage, which is not illustrated in the drawings, by a first fuel pipe 38*a*, and the second fuel flow-in passage 37*b* of the second fuel distribution pipe 37 is connected with the pump discharge passage by a second fuel pipe 38*b*.

Then, a part of the fuel increased in pressure by the fuel pump is supplied to the first fuel injection valve J1 mounted at the first fuel distribution pipe 36 through the first fuel pipe 38*a*, and another part of the fuel increased in pressure by the fuel pump is supplied to the second fuel injection valve J2 mounted at the second fuel distribution pipe 37 through the second fuel pipe 38*b*.

According to the conventional structure of the fuel supply pipe as described above, two long first and second fuel pipes are necessary between the throttle body 30 and the fuel pump.

More particularly, the reasons why such long pipes are necessary are that the fuel pump is provided in a fuel tank or near the fuel tank which is positioned far from an internal combustion engine and the throttle body 30 is provided near the internal combustion engine.

According to the above, in a motorcycle or the like in which the internal combustion engine, the throttle body 30 and the fuel tank are provided to be directly exposed to the atmosphere, the two fuel pipes 38*a*, 38*b* are also directly exposed to the atmosphere. Thus, an appearance is poor, and designing freedoms of the two long fuel pipes are limited in the motor cycle or the like not having enough housing space.

The structure of the fuel supply pipe in the throttle body comprising two fuel injection valves of the present invention solves the above-described problems, and an objective of the present invention is to provide the structure of the fuel supply pipe, in which the number of the long fuel pipes for connecting the fuel pump and the fuel distribution pipe is reduced from 2 to 1, so that the appearance of the motorcycle, designing freedom of the fuel pipe, and mountability to the motorcycle can be enhanced.

According to one aspect of the present invention, a structure of a fuel supply pipe in a throttle body comprising two fuel injection valves is made as follows, in order to obtain the above-described objective. In the throttle body comprising two fuel injection valves, a first fuel injection valve is provided toward an intake passage on the downstream side of the throttle valve for opening and closing the intake passage and a second fuel injection valve is provided toward the intake passage on the upstream side of the throttle valve. In such throttle body, the fuel supply pipe comprises a first fuel supply pipe, a second fuel supply pipe and a fuel connecting pipe. A first fuel supply pipe comprises a first inserting pipe projected toward one side direction X from a first cylindrical portion, and a fuel flow-in pipe projected toward another direction from the first cylindrical portion. A fuel flow-in passage is provided toward an end portion of the fuel flow-in pipe from an end portion of the first cylindrical portion. A first fuel supply passage is provided so as to be branched toward an end portion of the first inserting pipe from the fuel flow-in passage. A second fuel supply pipe comprises a second inserting pipe projected toward the one side direction X from a second cylindrical portion in parallel to the first inserting pipe. A second fuel supply passage is provided toward an end portion of the second inserting pipe from an end portion of the second cylindrical portion. A fuel connecting pipe connects the fuel flow-in passage and the second fuel supply passage, where the fuel flow-in passage is opened at the end portion of the first cylindrical portion of the first fuel supply pipe and the second fuel supply passage is opened at the end portion of the second cylindrical portion of the second fuel supply pipe. On the other hand, a first fuel distribution pipe for holding the first fuel injection valve with the throttle body, has a first inserting boss projected toward another side direction Y. The first inserting boss is provided with a first inserting hole in which one end thereof is connected with a first fuel injection valve inserting hole and another end is opened in the other side direction Y toward an end portion of the first inserting boss. Further, a second fuel distribution pipe for holding the second fuel injection valve with the throttle body has a second inserting boss projected toward the other side direction Y in parallel to the first inserting boss of the first fuel distribution pipe. The second inserting boss is provided with a second inserting hole, in which one end thereof is connected with a second fuel injection valve inserting hole and another end is opened in the other side direction Y toward an end portion of the second inserting boss. The first inserting pipe of the first fuel supply pipe is inserted and connected into the first inserting hole of the first fuel distribution pipe. The second inserting pipe of the second fuel supply pipe is inserted and connected into the second inserting hole of the second fuel distribution pipe. Further, the fuel supply pipe is screwed into the throttle body.

Further, according to another aspect of the present invention, the first inserting hole opened at the end portion of the first inserting boss of the first fuel distribution pipe and the second inserting hole opened at the end portion of the second inserting boss of the second fuel distribution pipe are approximate-rectangularly crossed with a longitudinal axial line Z—Z of the intake passage, and opened on another side wall side of the throttle body.

According to the one aspect of the present invention, the first fuel injection valve provided toward the intake passage on the downstream side of throttle valve is held by the throttle body and the first fuel distribution pipe comprising the first inserting boss provided with the first inserting hole opened toward the other side direction. Further, the second fuel injection valve provided toward the intake passage on the upstream side of the throttle valve is held by the throttle body and the second fuel distribution pipe comprising the second inserting boss provided with the second inserting hole opened toward the other side direction.

Further, the fuel supply pipe comprises the first fuel supply pipe formed by the first cylindrical portion, the fuel flow-in pipe, and the first inserting pipe projected toward the one side direction; the second fuel supply pipe formed by the second cylindrical portion and the second inserting hole projected toward the one side direction; and the fuel connecting pipe for connecting the fuel flow-in passage of the first cylindrical portion of the first fuel supply pipe and the second fuel supply passage of the second cylindrical portion of the second fuel supply pipe.

Further, the first inserting pipe of the first fuel supply pipe is inserted and connected into the first inserting hole of the first fuel distribution pipe, and the second inserting pipe of the second fuel supply pipe is inserted and connected into the second inserting hole of the second fuel distribution pipe. In this state, the fuel supply pipe is screwed into the throttle body.

Further, a fuel pipe is connected with the fuel flow-in pipe of the first fuel supply pipe, and is connected with a pump discharge passage of the fuel pump.

Therefore, when the fuel pump is driven simultaneously with a driving operation of the engine, fuel increased in pressure is supplied into the fuel flow-in passage of the first fuel supply pipe through the pump discharge passage and the fuel pipe. A part of the fuel is supplied to the first inserting hole of the first fuel distribution pipe through the first fuel supply passage, and the fuel is supplied to the first fuel injection valve.

On the other hand, another part of the fuel in the fuel flow-in passage is supplied to the second fuel supply passage of the second fuel supply pipe through the fuel connecting pipe, and the fuel is supplied to the second fuel injection valve through the second inserting hole of the second fuel distribution pipe.

When the structure of the fuel supply pipe as described above is used, only one long fuel pipe for connecting the fuel supply pipe and the fuel pump is necessary for use. Thus, the appearance of the motorcycle can be improved, and the designing freedom of the fuel pipe to the motorcycle can be improved.

Further, according to the another aspect of the present invention, the first inserting hole of the first fuel distribution pipe and the second inserting hole of the second fuel distribution pipe are rectangularly crossed with the longitudinal axial line of the intake passage, and are opened on the other side wall side of throttle body. Thus, the fuel supply pipe comprising the first fuel supply pipe and the second fuel supply pipe can be provided close to the other side wall side of the throttle body, and the throttle body including the fuel supply pipe can be made compact.

DETAILED DESCRIPTION OF PREFERRED EMBODIMENT

Hereinafter, one example of the structure of the fuel supply pipe in the throttle body comprising two fuel injection valves according to the present invention will be described with drawings.

One example of a fuel supply pipe F will be described with FIGS. 1 and 2.

Figure 1:
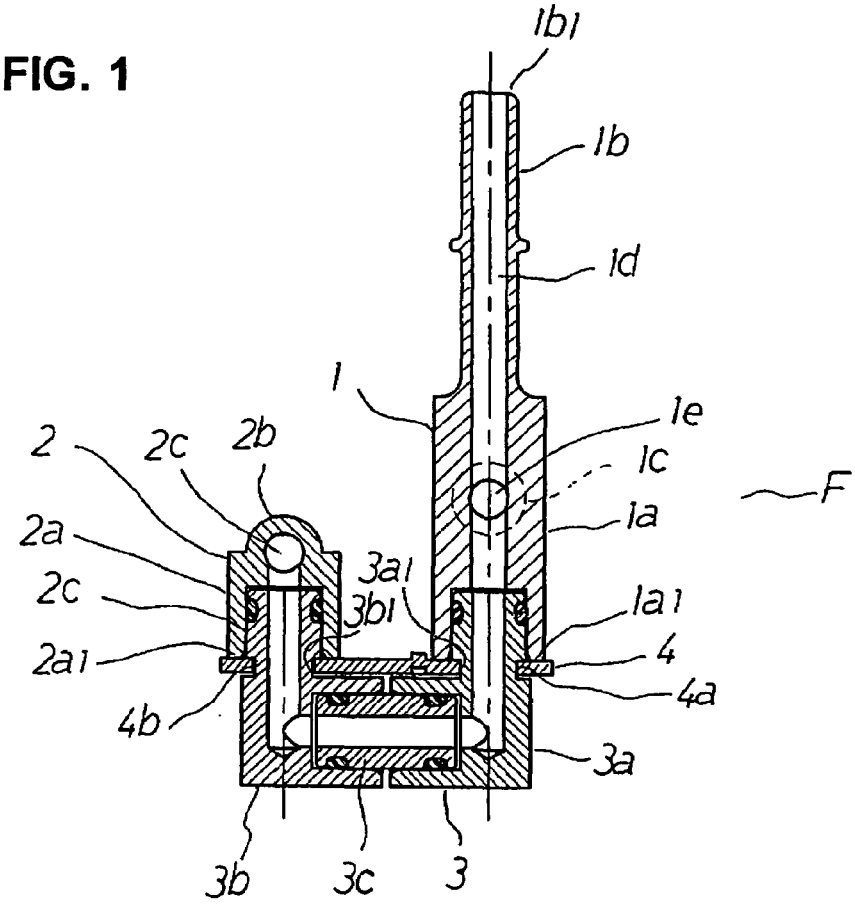
FIG. 1 is a longitudinal sectional view of a fuel supply pipe used in the present invention.

FIG. 1 is a longitudinal sectional view of a fuel supply pipe.

Figure 2:
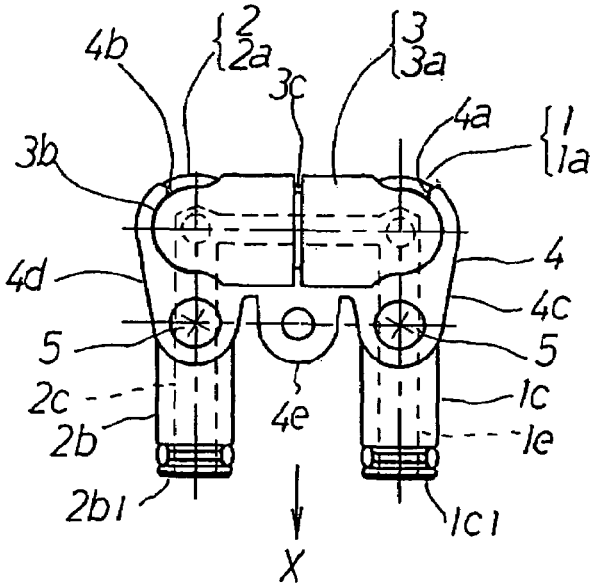
FIG. 2 is a bottom plan view seen from the bottom of FIG. 1.

FIG. 2 is a bottom plan view seen from the bottom of FIG. 1.

A reference symbol 1*a* is a first cylindrical portion extending upwardly and downwardly in FIG. 1, and a fuel flow-in pipe 1*b* is projected toward the upper direction further from the first cylindrical portion 1*a*.

A first inserting pipe 1*c* is formed to project toward one side direction X at an outer circumference portion of the first cylindrical portion.

Here, the one side direction is a back side of a paper in FIG. 1 and a lower side in FIG. 2.

Further, a fuel flow-in passage 1*d* is provided toward an end portion 1*b*1 (upper end) of the fuel flow-in pipe 1*b* from an end portion 1*a*1 (lower end) of the first cylindrical portion 1*a*. Further, a first fuel supply passage 1*e* is provided toward an end portion 1*c*1 of the first inserting pipe 1*c* from the fuel flow-in passage 1*d*.

The first fuel supply passage le is also opened toward the one side direction X.

The first fuel supply pipe 1 is formed to have the above-described constitution.

A reference symbol 2*a* is a second cylindrical portion extending upwardly and downwardly in FIG. 1, and a second inserting pipe 2*b* is projected toward the one side direction X from the second cylindrical portion 2*a*.

Further, a second fuel supply pipe 2*c* is provided toward an end portion 2*b*1 of the second inserting pipe 2*b* from an end portion 2*a*1 (lower end) of the second cylindrical portion 2*a*. At this time, a second fuel supply passage 2*c* opened toward the second inserting pipe 2*b* and the end portion 2*b*1 is formed in parallel to the first fuel supply passage 1*e* opened toward the first inserting pipe 1*c* and the end portion 1*c*1.

The second fuel supply pipe 2 is formed to have the above-described constitution.

Then, flowing passages of the first fuel supply pipe and the second fuel supply pipe 2 are connected with a fuel connecting pipe 3.

In this embodiment, the fuel connecting pipe 3 comprises a L shaped first connecting pipe 3*a* which is bent in the left direction, a L shaped second connecting pipe 3*b* which is bent in the right direction, and a connecting pipe 3*c* for connecting opposite portions of the first connecting pipe 3*a* and the second connecting pipe 3*b*.

Further, an upper portion of the first connecting pipe 3*a* is inserted into the fuel flow-in passage 1*d* which is opened at the end portion 1*a*1 of the first cylindrical portion 1*a* of the first fuel supply pipe 1 and expanded. An upper portion of the second connecting pipe 3*a* is inserted into the second fuel supply passage 2*c* which is opened at the end portion 2*a*1 of the second cylindrical portion 2*a* of the second fuel supply pipe 2 and expanded. In such inserting state, the first connecting pipe 3*a* is screwed into the first cylindrical portion 1*a* and the second connecting pipe 3*b* is screwed into the second cylindrical portion 2*a*, through a mounting plate 4.

More particularly, a first U shaped hole 4*a* of the mounting plate 4 is fitted into a first shrunk diameter portion 3*a*1 provided at the first connecting pipe 3*a*, and a second U shaped hole 4*b* of the mounting plate 4 is fitted into a second shrunk diameter portion 3*b*1 provided at the second connecting pipe 3*b*. In such fitting state, a first flange portion 4*c* of the mounting plate 4 is screwed to the first cylindrical portion 1*a* with a screw 5, a second flange portion 4*d* of the mounting plate 4 is screwed to the second cylindrical portion 2*a* with the screw 5.

In this way, the fuel supply pipe F comprising the first fuel supply pipe 1, the fuel connecting pipe 3, and the second fuel supply pipe 2 is formed. The first inserting pipe 1*c* and the second inserting pipe 2*b* in the fuel supply pipe F are arranged in parallel in the one side direction X.

In addition, 4*e* is a third flange portion extending outwardly from the mounting plate 4 and used when screwing the mounting plate 4 to the throttle body.

Then, a first fuel distribution pipe 6 and a second fuel distribution pipe 7 will be described with FIGS. 3 and 4.

Figure 5:
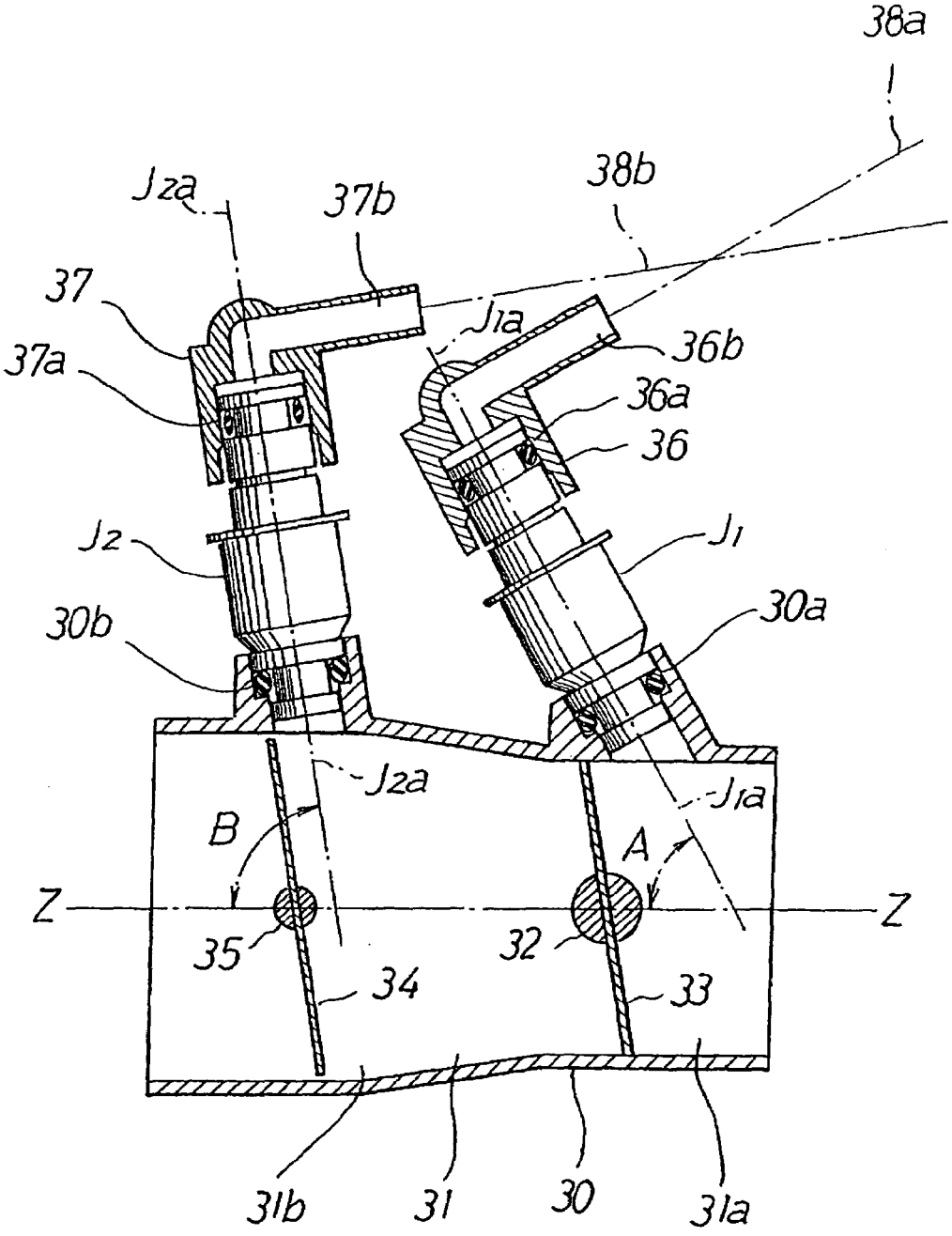
FIG. 5 is a longitudinal sectional view of main portions illustrating a conventional structure of a fuel supply pipe in a throttle body comprising two fuel injection valves.

In addition, a throttle body, a throttle valve and a sub-throttle valve are same as those in FIG. 5, so that same reference symbols are used and explanation is omitted.

A first fuel distribution pipe 6 comprises a first inserting cylindrical portion 6*b* and a first inserting boss 6*c*. The first inserting cylindrical portion 6*b* is provided with a first fuel injection valve inserting hole 6*a* for inserting a rear end portion of the first fuel injection valve J1 so as to be opened downwardly. The first inserting boss 6*c* is projected in another side direction Y in FIG. 3 from the first inserting cylindrical portion 6*b*. Further, the first inserting hole 6*d* connecting from an end portion 6*c*1 of the first inserting valve boss 6*c* to the first fuel injection inserting hole 6*a* is provided. The first inserting hole 6*d* provided at the first inserting boss 6*c* is also opened in the other side direction Y in FIG. 3.

Further, a rear end portion of the first fuel injection valve J1 is inserted into the first fuel injection valve inserting hole 6*a* of the first fuel distribution pipe 6, where a top end portion of the first fuel injection valve J1 is inserted into the first inserting hole 30*a* of the throttle body 30. In this state, the first fuel distribution pipe 6 is screwed to the throttle body 30 by a screw. Accordingly, the first fuel injection valve J1 is held between the throttle body 30 and the first fuel distribution pipe 6.

Further, in the state where the first fuel distribution pipe 6 is screwed to the throttle body 30, the first inserting hole 6*d* provided at the first inserting boss 6*c* is arranged so as to approximate-rectangularly cross with the longitudinal axial line Z—Z of the intake passage 31, and to be opened on the other side wall 30*d* side of the throttle body 30.

Figure 3:
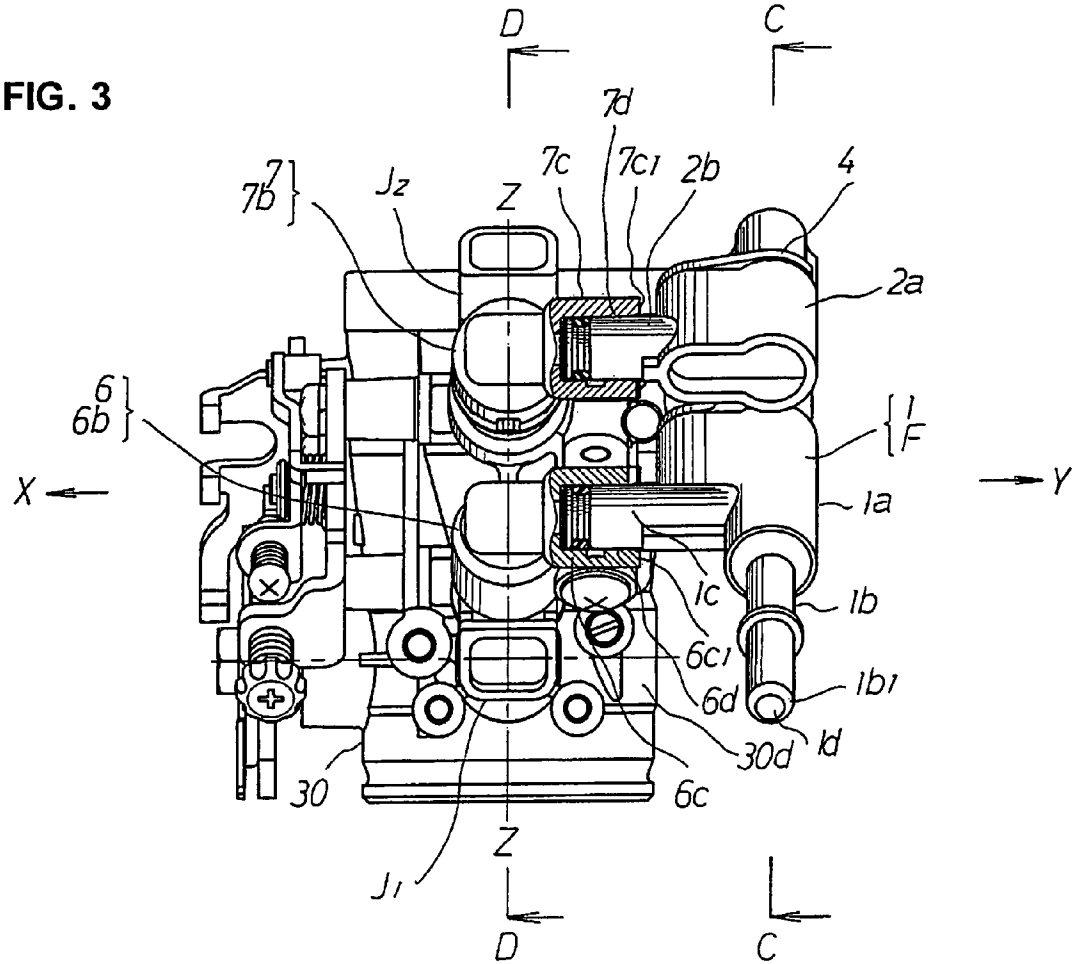
FIG. 3 is a top plan view illustrating one example of a structure of a fuel supply pipe in a throttle body comprising two fuel injection valves according to the present invention.
Figure 4:
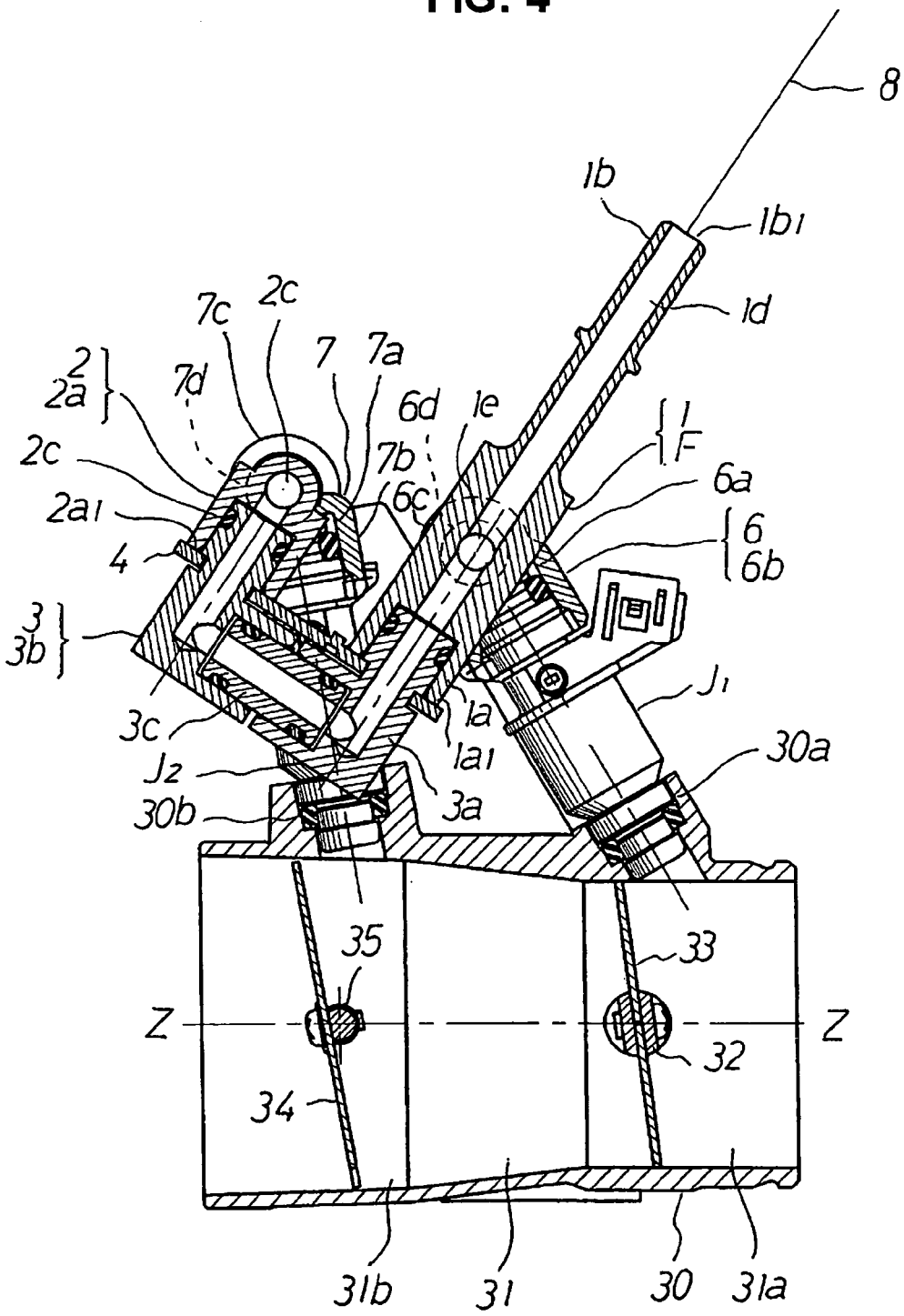
FIG. 4 is a longitudinal sectional view simultaneously illustrating cross sections of main portions taken along the C—C line and the D—D line of FIG. 3.

This state is illustrated in FIG. 3.

A second fuel distribution pipe 7 comprises a second inserting cylindrical portion 7*b* and a second inserting boss 7*c*. The second inserting cylindrical portion 7*b* is provided with a second fuel injection valve inserting hole 7*a* for inserting a rear end portion of the second fuel injection valve J2 so as to be opened downwardly. The second inserting boss 7*c* is projected in the other side direction Y in FIG. 3 from the second inserting cylindrical portion 7*b*. Further, a second inserting hole 7*d* connecting from an end portion 7*c*1 of the second inserting boss 7*c* to the second fuel injection valve inserting hole 7*a* is provided. The second inserting hole 7*d* provided at the second inserting boss 7*c* is also opened in the other side direction Y in FIG. 3. Further, a rear end portion of the second fuel injection valve J2 is inserted into the second fuel injection valve inserting hole 7*a* of the second fuel distribution pipe 7, where a top end portion of the second fuel injection valve J2 is inserted into the second inserting hole 30*b* of the throttle body 30. In this state, the second fuel distribution pipe 7 is screwed to the throttle body 30 by a screw. Accordingly, the second fuel injection valve J2 is held between the throttle body 30 and the second fuel distribution pipe 7.

Further, in the state where the second fuel distribution pipe 7 is screwed to the throttle body 30, the second inserting hole 7*d* provided at the second inserting boss 7*c* is arranged so as to approximate-rectangularly cross with the longitudinal axial line Z—Z of the intake passage 31, and to be opened on the other side wall 30*d* side of the throttle body 30.

Furthermore, the second inserting hole 7*d* including the second inserting boss 7*c* is provided in parallel to the second inserting hole 6*d* including the first inserting boss 6*c*, and the both are opened in the other side direction Y.

Then, the fuel supply pipe F is mounted toward the first and second fuel distribution pipes 6 and 7.

That is, the first inserting pipe 1*c* of the fuel supply pipe F is inserted into the first inserting hole 6*d* of the first fuel distribution pipe 6, and the second inserting pipe 2*b* is inserted into the second inserting hole 7*d* of the second fuel distribution pipe 7. In this state, the mounting plate 4 is screwed fixedly at the throttle body 30 through the third flange portion 4*e* of the mounting plate 4. Accordingly, the fuel supply pipe F is arranged fixedly at the second fuel distribution pipes 6 and 7.

As described above, the reason why the first and second inserting pipes 1*c*, 2*b* can be inserted simultaneously into the second inserting holes 6*d*, 7*d*, is that the first inserting pipe 1*c* and the second inserting pipe 2*b* are provided in parallel in the one side direction X and the first inserting hole 6*d* and the second inserting hole 7*d* are provided in parallel in the other side direction Y.

Then, one end of a fuel pipe 8 is connected to the fuel flow-in pipe 1*b* of the fuel supply pipe F, and another end thereof is connected to a pump discharge passage of the fuel pump which is not illustrated in the drawings. Then, the connections of the fuel pipes are completed.

Then, when the fuel pump is driven simultaneously with the driving operation of the engine, the fuel increased in pressure is supplied to the fuel pipe 8 from the pump discharge passage of the fuel pump. Then, a part of the fuel is supplied into the first inserting hole 6*d* of the first fuel distribution pipe 6 through the fuel flow-in passage 1*d* and the first fuel supply passage 1*e* of the fuel supply pipe F. The fuel in the first inserting hole 6*d* is injected and supplied into the intake passage 31*a* on the downstream side from the throttle valve through the first fuel injection valve J1.

Further, another part of the fuel in the fuel flow-in passage 1*d* is supplied into the second inserting hole 7*d* of the second fuel distribution pipe 7 through the first connecting pipe 3*a*, the connecting pipe 3*c* and the second connecting pipe 3*b*, which constitute the fuel connecting pipe 3. The fuel in the second inserting hole 7*d* is injected and supplied into the intake passage 31*b* on the upstream side from the throttle valve through the second fuel injection valve J2.

According to the structure of the fuel supply pipe in the throttle body comprising two fuel injection valves, by using the fuel supply pipe F comprising the first fuel supply pipe 1, the fuel connecting pipe 3 and the second fuel supply pipe 2, only one fuel pipe 8 having a long length is necessary for connecting the fuel supply pipe and the pump discharge passage in the fuel pump. Therefore, the piping can be made neat and compact, and the designing freedom of the piping of the fuel pipe can be enhanced.

Further, according to the above-described structure, especially, in the motorcycle or the like in which machines including the throttle body are arranged to be directly exposed to the atmosphere, the appearance can be improved, and the moutability to the motorcycle can be improved.

Further, since the first inserting hole 6*d* of the first fuel distribution pipe 6 and the second inserting hole 7*d* of the second distribution pipe 7 are approximate-rectangularly crossed with the longitudinal axial line Z—Z of the intake passage 31 and opened on the other side wall 30*d* side of the throttle body 30, the fuel supply pipe F can be arranged along the side wall of the throttle body 30. Thus, the whole of the throttle body 30 including the fuel supply pipe F can be effectively made compact.

In addition, as for the structure of the fuel connecting pipe 3, it is necessary that only the flow passages of the fuel flow-in passage 1*d* and the second fuel supply passage 2*c* are connected. Thus, the structure is not limited to the examples, and a mounting method of the fuel supply pipe F to the throttle body 30 is not limited to the mounting by the mounting plate 4.

What is claimed is:

1. A structure of a fuel supply pipe in a throttle body comprising two fuel injection valves, in which a first fuel injection valve is provided toward an intake passage on the downstream side of a throttle valve for opening and closing an intake passage, and a second fuel injection valve is provided toward the intake passage on the upstream side of the throttle valve, wherein the fuel supply pipe comprising;

a first fuel supply pipe comprising a first inserting pipe projected toward one side direction from a first cylindrical portion and a fuel flow-in pipe projected toward another direction from the first cylindrical portion, in which a fuel flow-in passage is provided toward an end portion of the fuel flow-in pipe from an end portion of the first cylindrical portion, and a first fuel supply passage is provided so as to be branched toward an end portion of the first inserting pipe from the fuel flow-in passage;

a second fuel supply pipe, in which a second inserting pipe projected toward the one side direction from a second cylindrical portion in parallel to the first inserting pipe, is provided and a second fuel supply passage is provided toward an end portion of the second inserting pipe from an end portion of the second cylindrical portion; and a fuel connecting pipe for connecting the fuel flow-in passage and the second fuel supply passage, in which the fuel flow-in passage is opened at the end portion of the first cylindrical portion of the first fuel supply pipe and the second fuel supply passage is opened at the end portion of the second cylindrical portion of the second fuel supply pipe, wherein a first fuel distribution pipe for holding a first fuel injection valve with a throttle body has a first inserting boss projected toward the another side direction, and the first inserting boss is provided with a first inserting hole, in which one end is connected with a first fuel injection valve inserting hole and another end is opened in the other side direction toward an end portion of the first inserting boss, wherein a second fuel distribution pipe for holding a second fuel injection valve with the throttle body has a second inserting boss projected toward the other side direction in parallel to the first inserting boss of the first fuel distribution pipe, and the second inserting boss is provided with a second inserting hole, in which one end is connected with a second fuel injection valve inserting hole and another end is opened in the other side direction toward an end portion of the second inserting boss, wherein the first inserting pipe of the first fuel supply pipe is inserted and connected into the first inserting hole of the first fuel distribution pipe and the second inserting pipe of the second fuel supply pipe is inserted and connected into the second inserting hole of the second fuel distribution pipe, and wherein the fuel supply pipe is screwed into the throttle body.

2. The structure of the fuel supply pipe in the throttle body comprising two fuel injection valves as claimed in claim 1, wherein the first inserting hole opened at the end portion of the first inserting boss of the first fuel distribution pipe and the second inserting hole opened at the end portion of the second inserting boss of the second fuel distribution pipe are approximate-rectangularly crossed with a longitudinal axial line of an intake passage, and are opened on another side wall side of the throttle body.

* * * * *